US006835905B1

(12) United States Patent
Dutkiewicz

(10) Patent No.: US 6,835,905 B1
(45) **Date of Patent: *Dec. 28, 2004**

(54) PULL-STRING SWITCH SYSTEM

(76) Inventor: Edward P. Dutkiewicz, 4205 Kent Dr., Largo, FL (US) 33774-1018

( * ) Notice: Subject to any disclaimer, the term of this patent is extended or adjusted under 35 U.S.C. 154(b) by 0 days.

This patent is subject to a terminal disclaimer.

(21) Appl. No.: 10/755,695

(22) Filed: Jan. 12, 2004

Related U.S. Application Data

(63) Continuation-in-part of application No. 10/637,207, filed on Aug. 9, 2003, now Pat. No. 6,743,996.

(51) Int. Cl.[7] ..... H01H 3/20
(52) U.S. Cl. ..... 200/331; 200/543
(58) Field of Search ..... 200/537, 538, 200/543–546, 329–331; 416/5, 146 R, 170 R; 315/362; 362/394, 395

(56) References Cited

U.S. PATENT DOCUMENTS

| | | | | | |
|---|---|---|---|---|---|
| 2,382,823 | A | * | 8/1945 | Schoenberg | 362/394 |
| 2,627,569 | A | * | 2/1953 | Legere et al. | 200/338 |
| 5,508,484 | A | * | 4/1996 | Chen | 200/302.1 |
| 5,993,159 | A | * | 11/1999 | Mack | 416/146 R |
| 6,423,919 | B1 | * | 7/2002 | Liao et al. | 200/543 |
| 6,743,996 | B1 | * | 6/2004 | Dutkiewicz | 200/543 |

* cited by examiner

*Primary Examiner*—Michael A. Friedhofer
(74) *Attorney, Agent, or Firm*—Edward P. Dutkiewicz

(57) ABSTRACT

A pull-chain switch system comprising several components in combination. First provided is a pull-chain switch with a spring of a first stiffness. Next provided is a switch subassembly having mounting portion and a pivoting member and a spring having a second stiffness. The second stiffness is greater than the first stiffness. Lastly provided is a means for coupling the subassembly to the pull-chain switch.

8 Claims, 7 Drawing Sheets

FIG 1
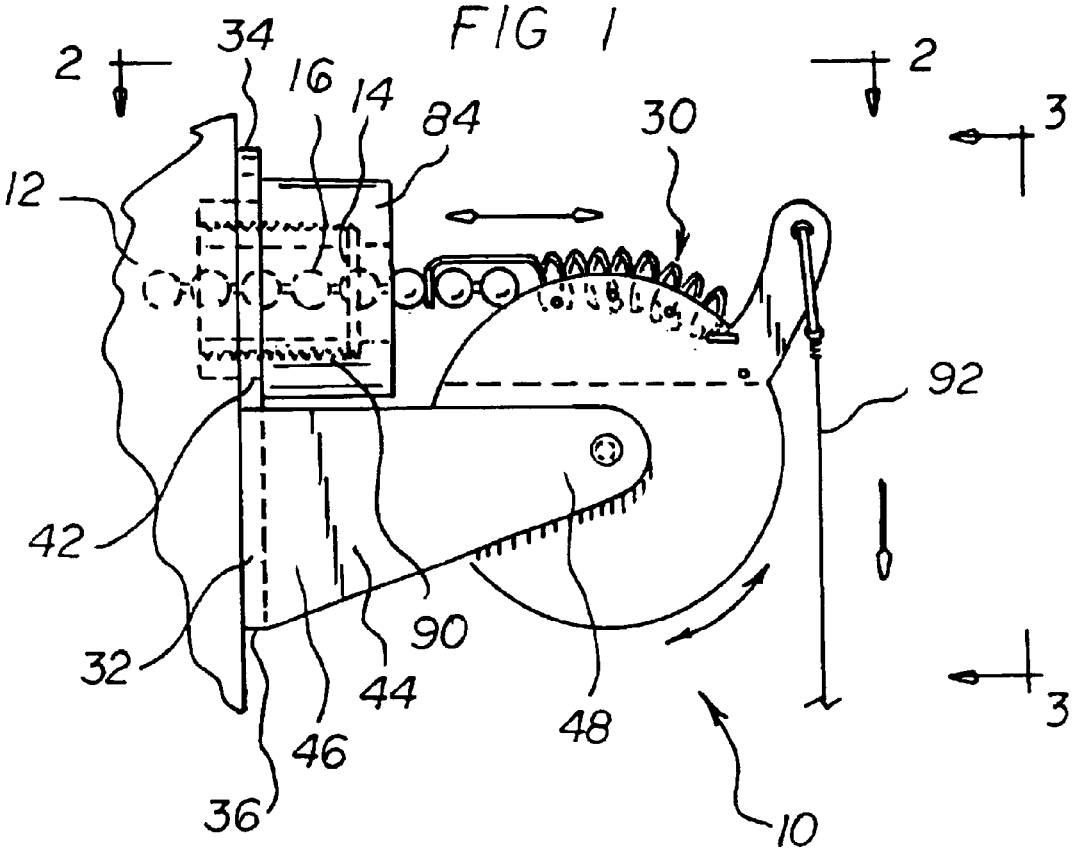
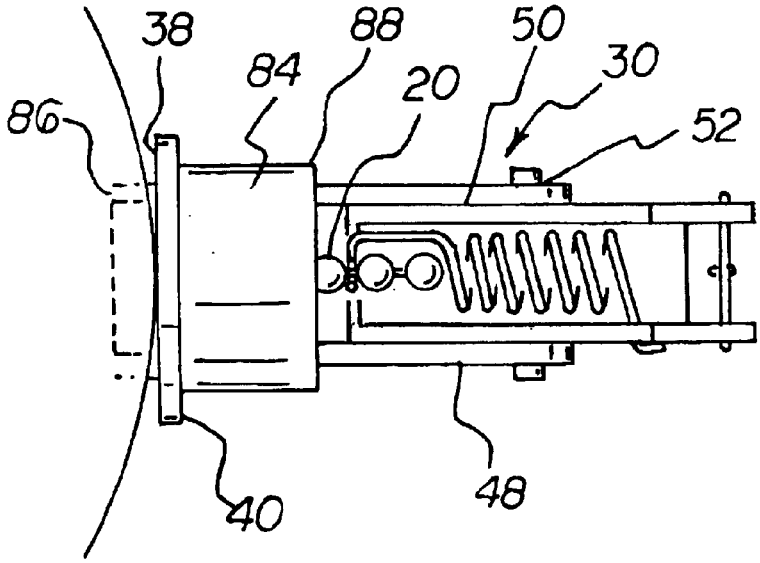
FIG 2

FIG 3
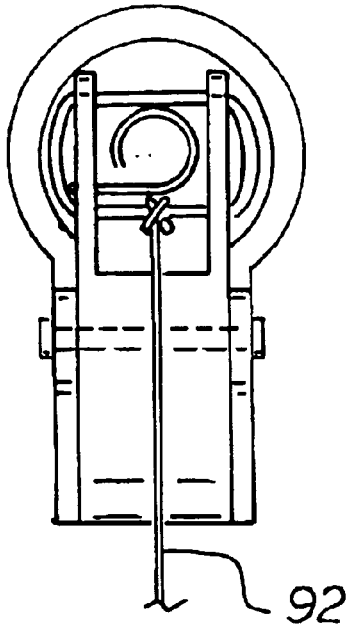
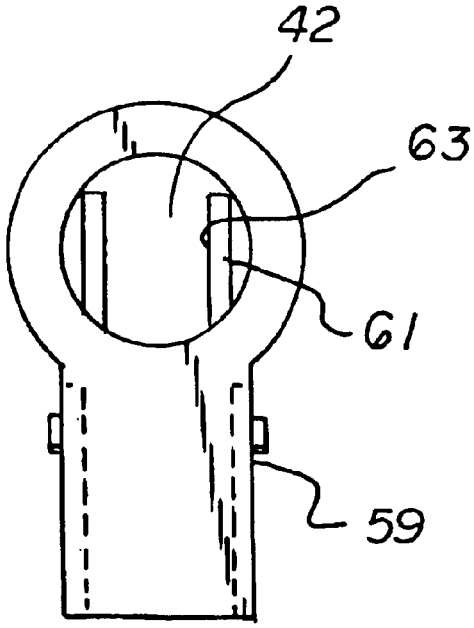
FIG 4

FIG 5
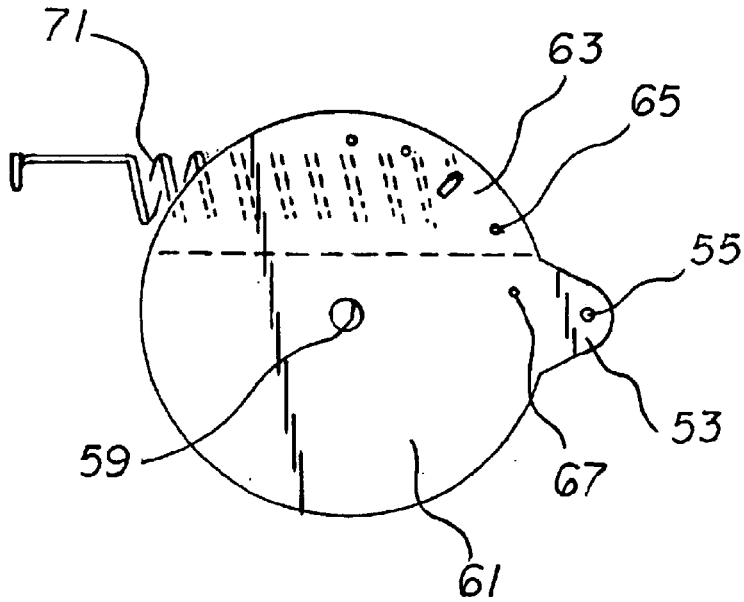
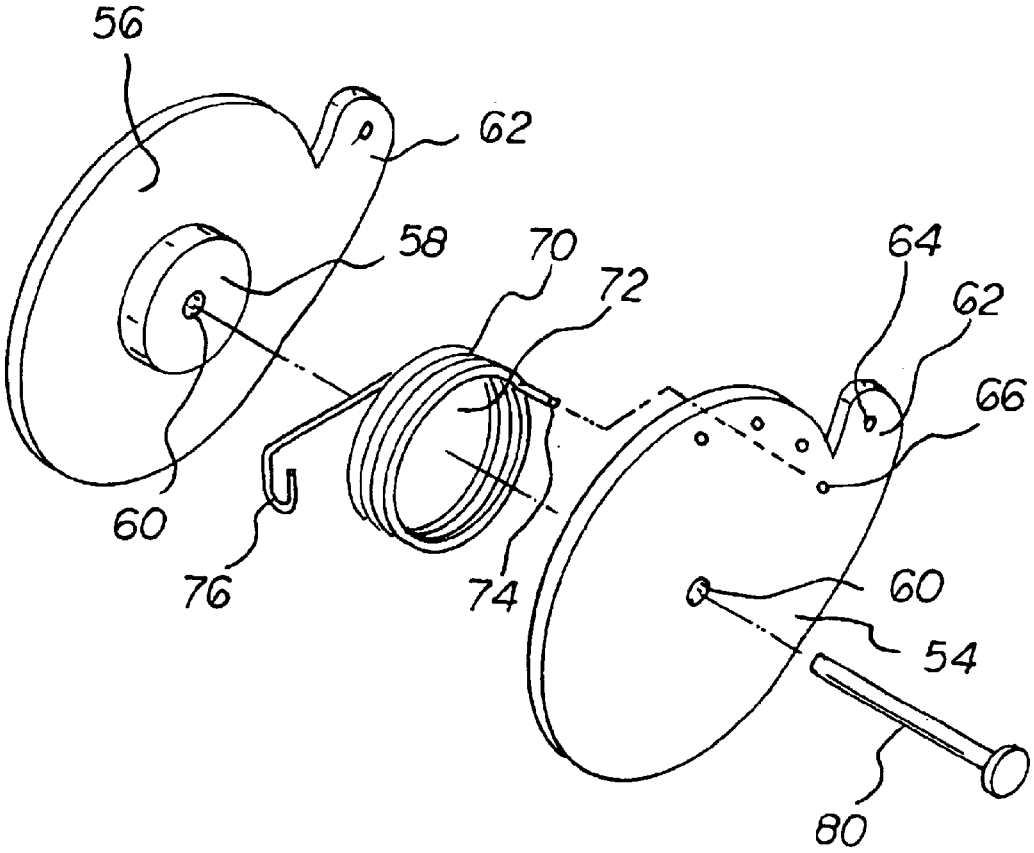
FIG 6

PULL-STRING SWITCH SYSTEM

RELATED PATENTS

This application is a Continuation in Part of a previous application Ser. No. 10/637,207 filed Aug. 9, 2003 now U.S. Pat. No. 6,743,996.

BACKGROUND OF THE INVENTION

1. Field of the Invention

The present invention relates to a pull-string Switch System and more particularly pertains to allowing a user to conveniently and efficiently operate a pull-string switch.

2. Description of the Prior Art

The use of other known methods and apparatuses of expected and known configurations is known in the prior art. More specifically, other known methods and apparatuses of expected and known configurations previously devised and utilized for the purpose of allowing a user to operate a pull-string switch are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,520,739 issued to Tsuji on Feb. 18, 2003, discloses a ceiling fan with light assembly. U.S. Pat. No. 6,450,658 issued to Tsuji et al on Sep. 17, 2002 discloses a Ceiling fan with light assembly. Lastly, U.S. Pat. No. 6,431,822 issued to Schwing on Aug. 13, 2002 discloses a fan support assembly.

While these devices fulfill their respective, particular objectives and requirements, the aforementioned patents do not describe pull-string Switch System that allows allowing a user to conveniently and efficiently operate a pull-string switch.

In this respect, the Pull-string Switch System according to the present invention substantially departs from the conventional concepts and designs of the prior art, and in doing so provides an apparatus primarily developed for the purpose of allowing a user to conveniently and efficiently operate a pull-string switch.

Therefore, it can be appreciated that there exists a continuing need for a new and improved Pull-string Switch System which can be used for allowing a user to conveniently and efficiently operate a pull-string switch. In this regard, the present invention substantially fulfills this need.

SUMMARY OF THE INVENTION

In view of the foregoing disadvantages inherent in the known types of other known methods and apparatuses of expected and known configurations now present in the prior art, the present invention provides an improved Pull-string Switch System. As such, the general purpose of the present invention, which will be described subsequently in greater detail, is to provide a new and improved Pull-string Switch System and method which has all the advantages of the prior art and none of the disadvantages.

To attain this, the present invention essentially comprises a pull-chain switch system for allowing a user to conveniently and efficiently operate a pull-chain switch. The system comprises several components in combination. First provided is a pull-chain switch. The pull-chain switch has an externally threaded mounting portion with a passageway there through. The mounting portion has a first diameter. There is a switch portion having a first length of ball-chain coupled to the switch having a spring of a first stiffness. The ball-chain protrudes from and passing through the passageway. Next provided is a switch subassembly. The switch subassembly has several components. The components comprise a mount, a pin, a pair of discs, a spring and a nut. The mount has an attachment portion having an upper end and a lower end. The attachment portion has an inside surface and an outside surface. The attachment portion has an aperture there through. The attachment aperture has a second diameter, with the second diameter being larger than the first diameter. The second diameter aperture being sized to loosely receive the externally threaded mounting portion of the pull-chain switch. The mount has a brace portion. The brace portion is perpendicular to the attachment portion. The brace portion has an inward end and an outward end. The inward end of the brace is coupled to the attachment portion. The brace is located in a position below the attachment aperture. The outward end of the brace has an upper-to-lower slot running there through. The slot bifurcates the outward end of the brace. Each of the bifurcated ends of the brace has an in-line pin aperture there through. The subassembly has a pair of discs being a first disc and a second disc. Each disc has an inward surface and an outward surface with a thickness there between. Each disc has a raised central portion of a second length and a third diameter. Each disc has a pin aperture of a fourth diameter there through. Each disc has an extending arm coupled to the inner surface, with the arm extending away from the disc. The arm has thickness of the second length. Each of the arms has a similarly located pull-string aperture there through. One of the discs has a spring aperture there through. The subassembly has a coiled spring having a second stiffness. The second stiffness is greater than the first stiffness. The spring has a central opening of a fifth diameter. The central opening of the spring is slightly larger than the third diameter with the spring. The spring has a fixation end and a hooked pull-chain attachment end. The subassembly has a pin of a fourth diameter. The pin is sized to be securely held within the pin aperture of the discs. The pin passes through the pin aperture of the first disc, then through the spring central opening, and then through the pin aperture of the second disc. The passage of the pin thereby coupling the spring between the two discs. The fixation end of the spring is coupled with the spring aperture of one of the discs. The hooked pull-chain end of the spring is movable in position between the two discs. The subassembly has a nut. The nut has a hollow tubular configuration with an inward end having a second external diameter and an outward end having a third external diameter and a length there between. The nut has an internal thread sized to be securely received by the thread of the externally threaded mounting portion of the pull-chain switch. The inward end is firmly received by the attachment aperture of the mount. Lastly provided is a pull-string coupled to the extending arms of the discs for allowing a user to activate the pull-chain switch.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pull-string Switch System which has all of the advantages of the prior art other known methods and apparatuses of expected and known configurations and none of the disadvantages.

It is another object of the present invention to provide a new and improved Pull-string Switch System which may be easily and efficiently manufactured and marketed.

It is further object of the present invention to provide a new and improved Pull-string Switch System which is of durable and reliable constructions.

An even further object of the present invention is to provide a new and improved Pull-string Switch System which is susceptible of a low cost of manufacture with regard to both materials and labor, and which accordingly is then susceptible of low prices of sale to the consuming public, thereby making such pull-string Switch System economically available to the buying public.

Even still another object of the present invention is to provide a Pull-string Switch System for allowing a user to conveniently and efficiently operate a pull-string switch.

Lastly, it is an object of the present invention to provide a new and improved pull-chain switch system comprising several components in combination. First provided is a pull-chain switch with a spring of a first stiffness. Next provided is a switch subassembly having mounting portion and a pivoting member and a spring having a second stiffness. The second stiffness is greater than the first stiffness. Lastly provided is a means for coupling the subassembly to the pull-chain switch.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevation of the Pull-string Switch System in place.

FIG. 2 is a top view taken along line 2—2 of FIG. 1.

FIG. 3 is a front view taken along line 3—3 of FIG. 1.

FIG. 4 is a rear view of the Pull-string Switch System.

FIG. 5 is a side view of the rotating disc showing the coupling of the spring with one of the apertures on the disc.

FIG. 6 is an exploded view of an alternate embodiment of the disc having two halves and a spring in between, the halves held together by the pin.

The same reference numerals refer to the same parts throughout the various Figures.

DESCRIPTION OF THE PREFERRED EMBODIMENT

Figure 7:
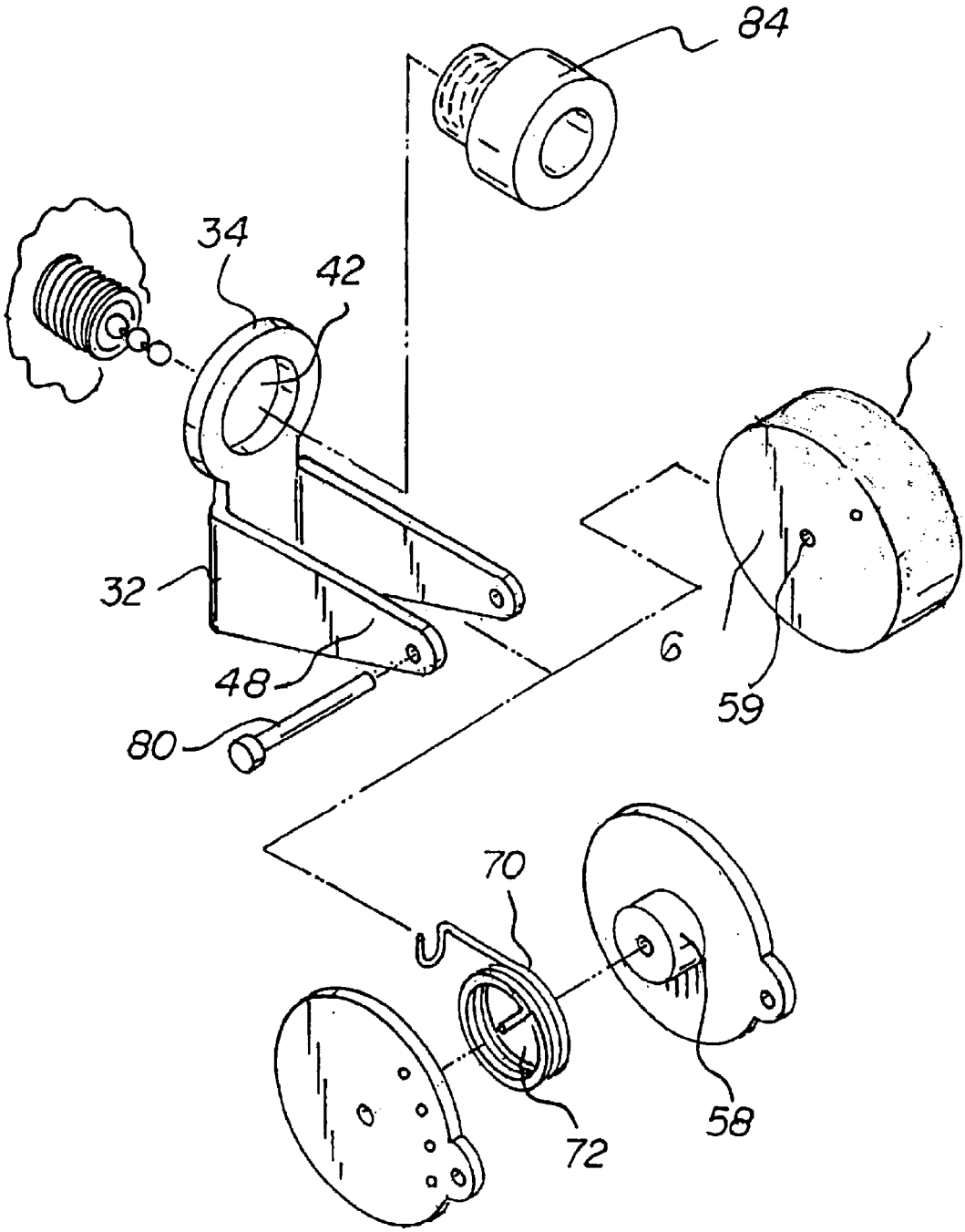
FIG. 7 is an exploded view of the system with two different disc mechanisms shown.

With reference now to the drawings, and in particular to FIG. 1 thereof, the preferred embodiment of the new and improved pull-string Switch System embodying the principles and concepts of the present invention and generally designated by the reference numeral 10 will be described.

The present invention, the Pull-string Switch System 10 is comprised of a plurality of components. Such components in their broadest context include a pull-string switch, a mounting bracket, a disc and a spring. Such components are individually configured and correlated with respect to each other so as to attain the desired objective.

Herein is described a pull-chain switch system 10 for allowing a user to conveniently and efficiently operate a pull-chain switch. The system comprises several components in combination.

First provided is a pull-chain switch 12. The pull-chain switch has an externally threaded mounting portion 14 with a passageway 16 there through. The mounting portion has a first diameter. There is a switch portion having a first length of ball-chain 20 coupled to the switch and protruding from and passing through the passageway. The switch comprises a spring (not shown) having a first stiffness.

Next provided is a switch subassembly 30. The switch subassembly has several components. The components comprise a mount, a pin, a disc, a spring and a nut.

The mount 32 has an attachment portion having an upper end 34 and a lower end 36. The attachment portion has an inside surface 38 and an outside surface 40. The attachment portion has an aperture 42 there through. The attachment aperture has a second diameter, with the second diameter being larger than the first diameter. The second diameter aperture being sized to loosely receive the externally threaded mounting portion of the pull-chain switch.

The mount has a brace portion 44. The brace portion is perpendicular to the attachment portion. The brace portion has an inward end 46 and an outward end 48. The inward end of the brace is coupled to the attachment portion. The brace is located in a position below the attachment aperture. The outward end of the brace has an upper-to-lower slot 50 running there through. The slot bifurcates the outward end of the brace. Each of the bifurcated ends of the brace has an in-line pin aperture 52 there through.

The subassembly has a pair of discs being a first disc 54 and a second disc 56. Each disc has an inward surface and an outward surface with a thickness there between. Each disc has a raised central portion 58 of a second length and a third diameter. Each disc has a pin aperture 60 of a fourth diameter there through. Each disc has an extending arm 62 coupled to the inner surface, with the arm extending away from the disc. The arm has thickness of the second length. Each of the arms has a similarly located pull-string aperture 64 there through. One of the discs has at least one spring aperture 66 there through.

The subassembly has a coiled spring 70 having a second stiffness. The second stiffness is greater than the first stiffness. The spring has a central opening 72 of a fifth diameter. The central opening having a fifth diameter being slightly larger than the third diameter. The spring has a fixation end 74 and a hooked pull-chain attachment end 76.

In an alternate configuration, the pair of discs may be substituted with a single disc 61 having a slot cut 63 through a chord on the disc. The slot being smaller than the thickness of the disc. The disc has an arm 53 with a string hole 55 for allowing the attachment of a pull string. The disc has a centrally located pin aperture 59. The slot defines a bifurcation, with one of the sides of the bifurcation having a spring attachment aperture 65 there through. The disc has a pulling arm 53 with a string hole there through 55.

Figure 8:
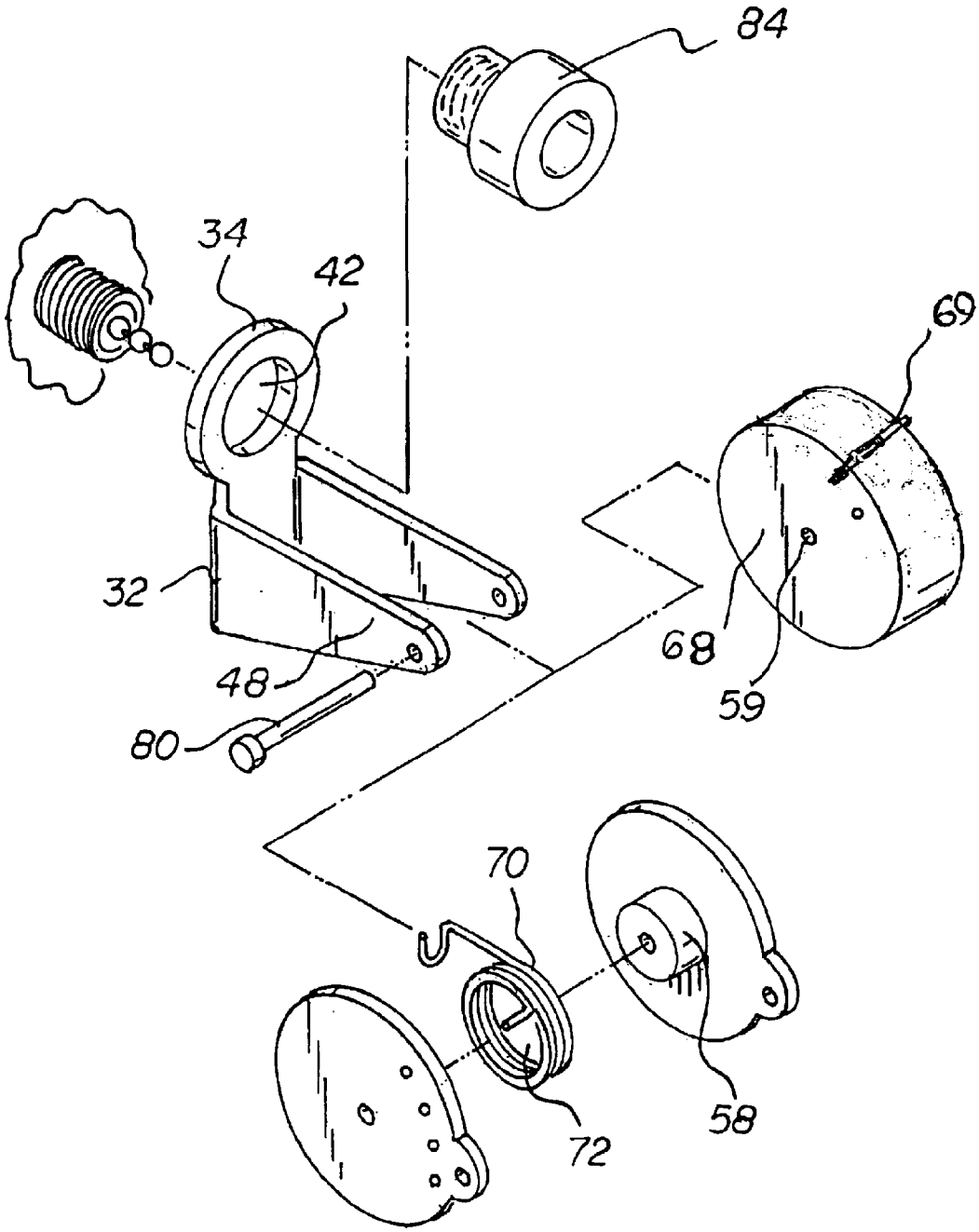
FIG. 8 is an exploded view of the system with two different disc mechanisms shown. The alternate embodiment of a disc having a pull-chain coupler and using no spring is demonstrated.
Figure 9:
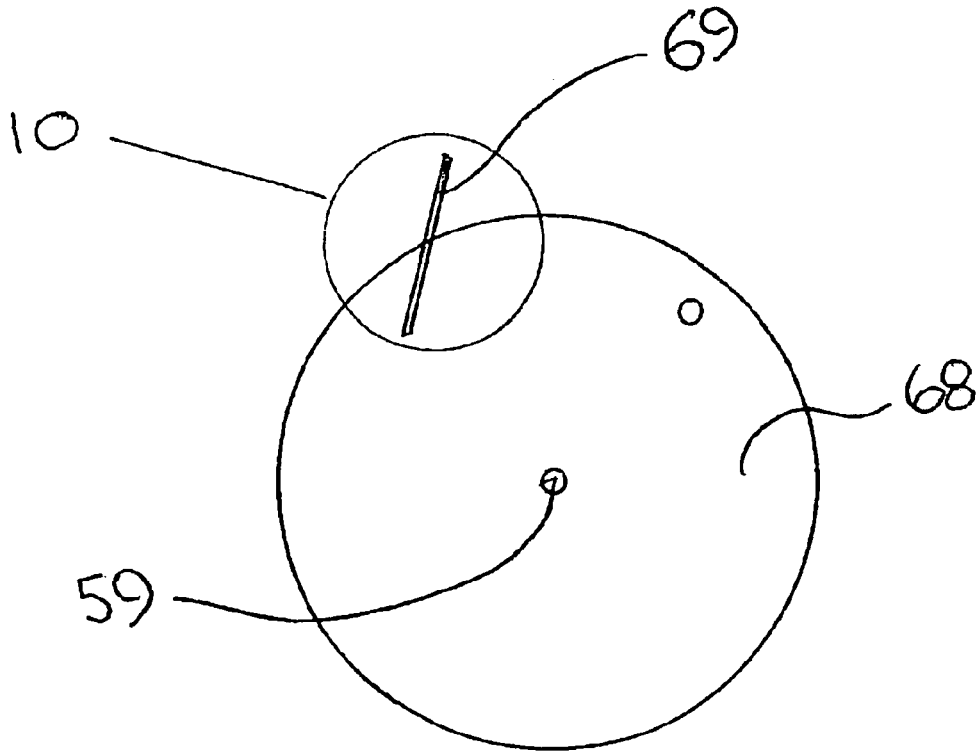
FIG. 9 is a side view of the disc with a pull-chain coupler.
Figure 10:
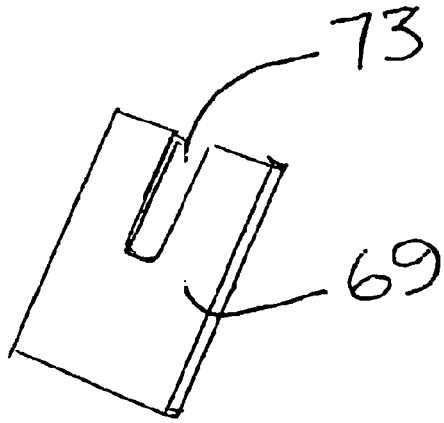
FIG. 10 is a perspective view of the pull-chain coupler as demonstrated in circle 10 of FIG. 9.
Figure 11:
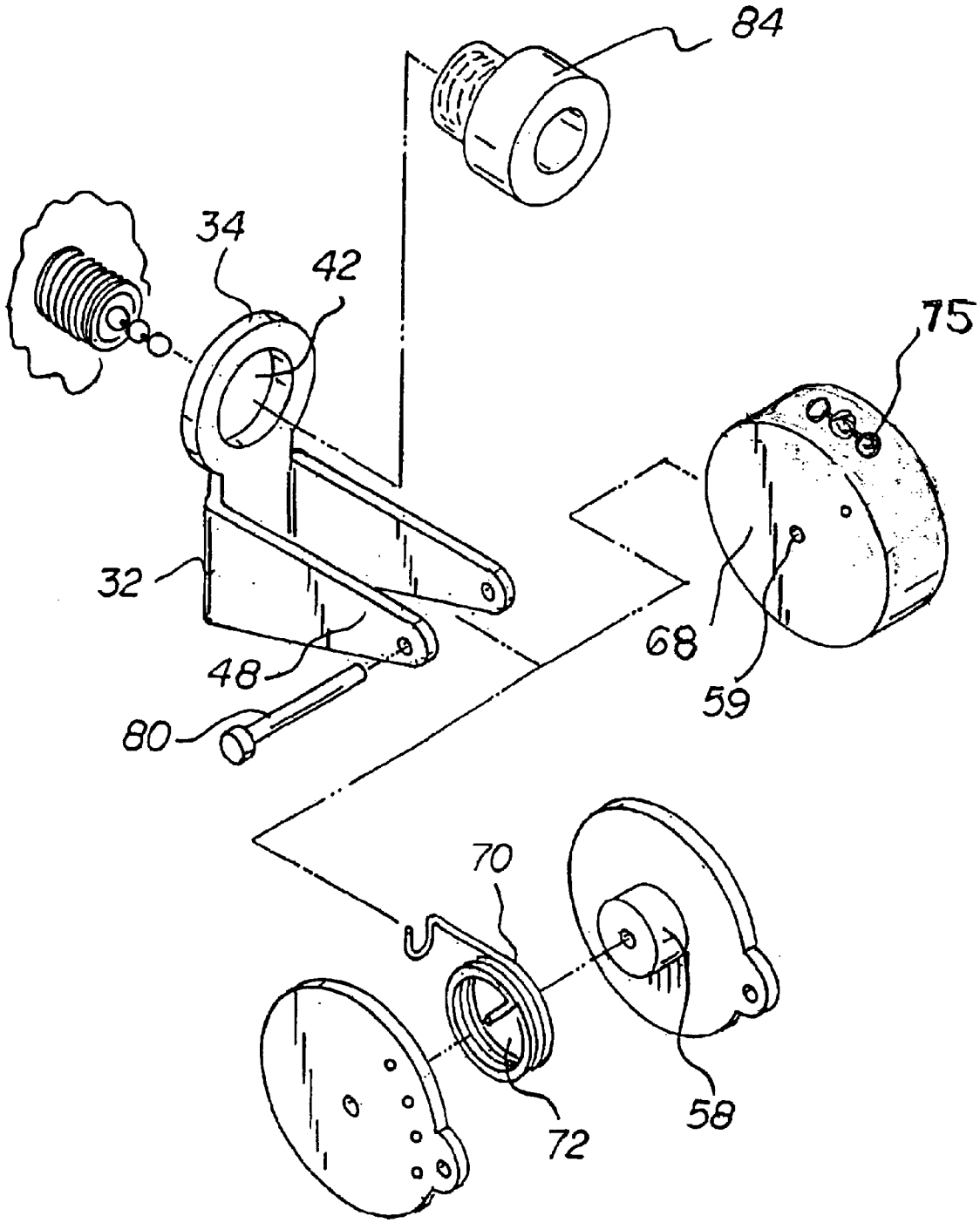
FIG. 11 is an exploded view of the system with two different disc mechanisms shown. The alternate embodiment of a disc having at least one recipient recess, for receiving a pull-chain and holding it firmly, is demonstrated.

In another alternate embodiment of the invention the single disc may be a smooth cylinder 68 with a pull-chain coupler 69. The coupler is coupled to the disc within an angled slot 73 in the disc. The coupler has a slot cut therein. The slot receives the pull-chain and holds it firmly. In this configuration there is no spring used in the system. A string couples to the disc, and when pulled, rotates the disc. The pull-chain coupler, in turn, pulls the pull-chain and activates the switch. As can be seen in FIGS. 5, 8, 9 and 11 the point of attachment of the pull-string (55, FIG. 5) and the point of attachment of the pull-chain (69 FIG. 8) are at about 90 degrees or less to each other, relative to the pivot point (59 FIG. 8). An alternate embodiment of the pull-chain coupler may be at least one recipient recess 75 on the peripheral surface of the disc so that the pull chain is nested and held firmly within the recipient recess of the disc.

In another alternate configuration the arm may be replaced by a pull-string aperture 67 on the periphery of the disc.

In an alternate configuration the disc may have a plurality of pin apertures to allow for adjustment of the spring.

In an alternate embodiment when a spring is employed, the spring may be a spring having an essentially straight orientation 71. The spring may be coupled to the disc and nested within the slot of the disc.

In an alternate configuration when a spring is employed, the springs may be of a same stiffness, or the switch spring may have a greater stiffness than the disc spring, that is, the first stiffness may be greater than the second stiffness.

The subassembly has a pin 80 of a fourth diameter. The pin is sized to be securely held within the pin aperture of the discs. The pin passes through the pin aperture of the first disc, then through the spring central opening, and then through the pin aperture of the second disc. The passage of the pin thereby couples the spring between the two discs. The fixation end of the spring is coupled with the spring aperture of one of the discs. The hooked pull-chain end of the spring is movable in position between the two discs.

The subassembly has a nut 84. The nut has a hollow tubular configuration with an inward end 86 having a second external diameter and an outward end 88 having a third external diameter and a length there between. The nut has an internal thread 90 sized to be securely received by the thread of the externally threaded mounting portion of the pull-chain switch. The inward end is firmly received by the attachment aperture of the mount.

Next provided is a pull-string 92 coupled to the extending arms of the discs for allowing a user to activate the pull-chain switch.

Lastly provided is a method for allowing a user to conveniently and efficiently make a pull-chain switch. The method comprises several steps in combination.

The first step is to provide a pull chain switch having a pull chain coupled thereto. The switch has a spring having a first stiffness.

The next step is to provide a pivotable member coupled to the switch.

The next step is to provide an pulling means being coupled to the pivotable member. The pulling means allows a user to pull on the pulling means and cause a rotation of the pivotable member. This rotation thereby activates the pull-chain switch and causes the pull-chain switch to function.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pull-chain switch system comprising, in combination:

a pull-chain switch having a spring, with a ball-chain coupled to the spring and protruding from the switch, the switch having an associated pull string;

a switch subassembly having a mount and a pin and a rotating member having a centrally located pivoting point, the rotating member also having a peripheral point of attachment for the ball chain and a peripheral point of attachment for the pull string, and a stepped nut, the mount having an attachment portion and a brace portion coupling the rotating member with the mount, the nut having an internal thread sized to couple with the pull-chain switch.

2. A pull-chain switch system comprising, in combination:

a pull-chain switch having a pull chain;

a switch subassembly having mounting portion and a pivoting member and a nut.

3. A pull-chain switch system as described in claim 2 wherein the nut is stepped.

4. A pull-chain switch system as described in claim 2 wherein a pull-string is coupled with the periphery of the rotating member and the pull-chain switch is coupled to the periphery of the rotating member.

5. A pull-chain switch system as described in claim 4 wherein the pull-chain and the pull-string are at an approximately acute angles to each other relative to the pivot point.

6. A pull-chain switch system comprising, in combination:

a pull-chain switch;

a switch subassembly having mounting portion and a pivoting member having a central point, with the pivoting member pivoting about an approximately central point; and a means for coupling the subassembly to the pull-chain switch.

7. A pull-chain switch system as described in claim 6 wherein the system further includes a disc having a periphery and having at least one recipient recess to receive and hold a pull-chain, the pull-chain being coupled to the periphery of the disc, the system also comprising a pull string, with the pull string being coupled to the periphery of the disc.

8. A method for allowing a user to conveniently and efficiently use a pull-chain switch comprising, in combination:

providing a pull chain switch having a pull chain coupled thereto;

providing a pivotable member coupled to the switch; and providing an pulling means being coupled to the periphery of the pivotable member thereby allowing a user to pull on the pulling means and cause a rotation of the pivotable member, thereby activating the pull-chain switch.

* * * * *